US009324281B2

(12) United States Patent
Hwang et al.

(10) Patent No.: US 9,324,281 B2
(45) Date of Patent: Apr. 26, 2016

(54) DISPLAY DEVICE AND DRIVING METHOD THEREOF

(75) Inventors: Hyun-Sik Hwang, Ansan-si (KR); Uk-Chul Choi, Cheonan-si (KR); Cheol-Woo Park, Suwon-si (KR); Jong-Hee Kim, Hwaseong-si (KR); KyoungHo Lim, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 1185 days.

(21) Appl. No.: 13/305,277

(22) Filed: Nov. 28, 2011

(65) Prior Publication Data

US 2013/0009938 A1 Jan. 10, 2013

(30) Foreign Application Priority Data

Jul. 6, 2011 (KR) ..... 10-2011-0067027

(51) Int. Cl.

| | |
|---|---|
| ***G09G 5/10*** | (2006.01) |
| ***G09G 3/34*** | (2006.01) |
| ***G09G 3/36*** | (2006.01) |

(52) U.S. Cl.

CPC ..... *G09G 3/348* (2013.01); *G09G 3/3644* (2013.01); *G09G 2300/0486* (2013.01); *G09G 2310/0221* (2013.01); *G09G 2310/067* (2013.01); *G09G 2310/08* (2013.01)

(58) Field of Classification Search

USPC ..... 345/87, 90, 92, 94, 690

See application file for complete search history.

(56) References Cited

U.S. PATENT DOCUMENTS

| | | | | |
|---|---|---|---|---|
| 7,119,772 | B2 * | 10/2006 | Amundson et al. | 345/87 |
| 7,129,922 | B2 * | 10/2006 | Shin | 345/90 |
| 2003/0103046 | A1 * | 6/2003 | Rogers et al. | 345/204 |
| 2009/0213056 | A1 * | 8/2009 | Nam et al. | 345/90 |
| 2009/0273553 | A1 | 11/2009 | Song et al. | |
| 2012/0002133 | A1 * | 1/2012 | Yamazaki et al. | 349/61 |

FOREIGN PATENT DOCUMENTS

| | | |
|---|---|---|
| JP | 2007-256391 | 10/2007 |
| JP | 2008-026377 | 7/2008 |
| KR | 10200060096859 | 9/2006 |
| KR | 1020080002570 | 1/2008 |
| KR | 1020080076129 | 2/2008 |
| KR | 1020080037754 | 5/2008 |
| KR | 1020100073544 | 7/2010 |

* cited by examiner

*Primary Examiner* — Calvin C Ma

(74) *Attorney, Agent, or Firm* — F. Chau & Associates, LLC

(57) ABSTRACT

A display device includes a first gate driver that applies a gate-on voltage to gate lines of a first gate line group in each period of n first scan periods for a first frame, n being a natural number. A second gate driver applies a gate-on voltage to gate lines of a second gate line group in each period of n second scan periods for a first frame. A data driver applies a data voltage to a plurality of data lines. A signal controller transmits a control signal to the first and second gate drivers and the data driver, wherein an interval between start points of the n first scan periods is gradually decreased according to time, and an interval between start points of the n second scan periods is gradually increased according to time.

40 Claims, 13 Drawing Sheets

FIG. 3

| Gray | S4, L4 | S3, L3 | S2, L2 | S1, L1 | Gray | S4, L4 | S3, L3 | S2, L2 | S1, L1 |
|---|---|---|---|---|---|---|---|---|---|
| 0 | 0V | 0V | 0V | 0V | 8 | 30V | 0V | 0V | 0V |
| 1 | 0V | 0V | 0V | 30V | 9 | 30V | 0V | 0V | 30V |
| 2 | 0V | 0V | 30V | 0V | 10 | 30V | 0V | 30V | 0V |
| 3 | 0V | 0V | 30V | 30V | 11 | 30V | 0V | 30V | 30V |
| 4 | 0V | 30V | 0V | 0V | 12 | 30V | 30V | 0V | 0V |
| 5 | 0V | 30V | 0V | 30V | 13 | 30V | 30V | 0V | 30V |
| 6 | 0V | 30V | 30V | 0V | 14 | 30V | 30V | 30V | 0V |
| 7 | 0V | 30V | 30V | 30V | 15 | 30V | 30V | 30V | 30V |

DISPLAY DEVICE AND DRIVING METHOD THEREOF

CROSS-REFERENCE TO RELATED APPLICATION

This application claims priority to and the benefit of Korean Patent Application No. 10-2011-0067027 filed in the Korean Intellectual Property Office on Jul. 6, 2011, the entire contents of which are incorporated by reference herein.

BACKGROUND (a) Technical Field

The present disclosure relates to a display device and a driving method thereof, and, more particularly, to a display device driven by a time division pulse width modulation method and a driving method thereof.

(b) Discussion of the Related Art

Typically, a display device includes a display panel including a plurality of pixels and display signal lines, a gate driver that applies a gate signal to a gate line among the display signal lines, and a data driver that applies a data voltage corresponding to an input image signal to a data line among the display signal lines. Each pixel may include a switching element connected to the display signal line and a pixel electrode connected thereto. The pixel electrode is applied with a data voltage according to the gate signal through the switching element.

For color display, each pixel PX uniquely represents one of primary colors such as red (R), green G) and blue (B), or each pixel PX sequentially represents the primary colors in turn.

When the gate driver applies a gate-on voltage to the gate line, the switching element connected to the gate line is turned on and the data voltage applied to the data line is applied to a corresponding pixel through the turned-on switching element. In this way, if the gate-on voltage is sequentially applied to all gate lines and all pixels receive the data voltage, an image of one frame is displayed. The input image signal corresponding to the image to be displayed by each pixel has information for luminance during one frame, that is, a gray level. When two grey levels are applied for the image to be displayed by the pixel, to display the image of several grays, the display device may be driven using time division pulse width modulation (PWM).

However, as a size of the display device is increased, the number of gate lines is increased and the time to display the image of one frame is increased such that it becomes difficult to increase the driving speed of the display device

SUMMARY

In accordance with exemplary embodiments of the present invention the driving speed of a display device driven by a time division pulse width modulation method is increased.

According to an exemplary embodiment, a display device is provided. A display panel includes a plurality of pixels, a plurality of gate lines, and a plurality of data lines. A first gate driver is configured to apply a gate-on voltage to gate lines of a first gate line group among the plurality of gate lines in each period of n first scan periods for a first frame, n being a natural number. A second gate driver is configured to apply a gate-on voltage to gate lines of a second gate line group among the plurality of gate lines in each period of n second scan periods for a first frame. A data driver is configured to apply a data voltage to a plurality of data lines. A signal controller is configured to transmit a control signal to the first gate driver, the second gate driver and the data driver, wherein an interval between start points of the n first scan periods is gradually decreased according to time, and the interval between start points of the n second scan periods is gradually increased according to time.

The n first scan periods and the n second scan periods may be not overlapped with each other.

A temporal difference between a start point of the first scan period among the n first scan periods for the first frame and a start point of the first scan period among the n second scan periods for the first frame may be smaller than one frame.

Each of the n first scan periods and each of the n second scan periods may be maintained during one scan time. An interval between two adjacent scan periods of the n first scan periods and an interval between two adjacent scan periods of the n second scan periods may respectively maintained during one scan time. The interval of the n first scan period and the interval between the n second scan periods may be a multiple of the one scan time.

An interval between start points of neighboring scan periods of the n first scan periods may be decreased by 1/k according to time, and an interval between start points of neighboring scan periods of the n second scan periods may be increased by a k, according to time, k being a natural number.

A start point of the first scan period of the n first scan periods may be earlier than a start point of the first scan period of the n second scan periods.

A start point of the first scan period of the n first scan periods may be later than a start point of the first scan period of the n second scan periods.

The signal controller may outputs a first scanning start signal and a first gate clock signal to the first gate driver, and a second scanning start signal and a second gate clock signal to the second gate driver.

An output sequence of first pulses of the first scanning start signal, each first pulse corresponding to the n respective first scan periods, may be opposite to an output sequence of second pulses of the second scanning start signal, each second pulse corresponding to the n respective second scan periods.

The first gate clock signal may be the same as the second gate clock signal.

A data voltage applied to a pixel during each scan period of the n first scan periods and the n second scan periods may be maintained until a next scan period starts after the each scan period is finished.

The signal controller may output a first scanning start signal and a first gate clock signal to the first gate driver, and a second scanning start signal and a second gate clock signal to the second gate driver.

The display device may further include a third gate driver configured to apply the gate-on voltage to gate lines of a third gate line group among the plurality of gate lines in each period of n third scan periods for the first frame.

The n first scan periods, the n second scan periods, and the third scan periods may not overlap.

Each of the n first scan periods, each of the n second scan periods, and each of the n third scan periods may be respectively maintained during one scan time. An interval between two adjacent scan periods of the n first scan periods, an interval between two adjacent scan periods of the n second scan periods, and an interval between two adjacent scan periods of the n third scan periods may be respectively a multiple of the one scan time.

A ratio of intervals between two start points of two adjacent scan periods among the n first scan periods may not have a multiple relationship.

When n is 3, a ratio of the intervals between the start points of neighboring scan periods of the n first scan periods may be 1:3:7.

The signal controller may output a first scanning start signal and a first gate clock signal to the first gate driver, a second scanning start signal and a second gate clock signal to the second gate driver, and a third scanning start signal and a third gate clock signal to the third gate driver.

The display device may be an electrowetting display device.

A reset scan period may be in the first frame.

The data voltage may have two or more values.

According to an exemplary embodiment a method is provided for driving a display device including a display panel having a plurality of pixels coupled to a plurality of gate lines and to a plurality of data lines, a first gate driver and a second gate driver coupled to the gate lines, a data driver coupled to the data lines, and a signal controller configured to provide control signals to the first and second gate drivers and to the data driver. The method includes applying a gate-on voltage to a first gate line group among the plurality of gate lines in each period of n first scan periods for a first frame by the first gate driver, n being a natural number, and applying a gate-on voltage to a second gate line group among the plurality of gate lines in each period of n second scan periods for the first frame by the second gate driver. An interval between start points of the n first scan periods is gradually decreased according to time, and an interval between start points of the n second scan periods is gradually increased according to time.

In the method the n first scan periods and the n second scan periods may not be overlapped with each other.

In the method, the temporal difference between a start point of the first scan period among the n first scan periods for the first frame and a start point of the first scan period among the n second scan periods for the first frame may be smaller than one frame.

In the method, each of the n first scan periods and each of the n second scan periods may be maintained during one scan time, and an interval between two adjacent scan periods of the n first scan period and an interval between two adjacent scan periods of the n second scan periods may be respectively a multiple of the one scan time.

In the method an interval between start points of neighboring scan periods of the n first scan periods may be decreased by 1/k according to time, k being a natural number, and an interval between start points of neighboring scan periods of the n second scan periods may be increased by k according to time.

In the method a start point of the first scan period of the n first scan periods may be earlier than a start point of the first scan period of the n second scan periods.

In the method a start point of the first scan period of the n first scan periods may be later than a start point of the first scan period of the n second scan periods.

The method may further include outputting a first scanning start signal and a first gate clock signal to the first gate driver by the signal controller, and outputting a second scanning start signal and a second gate clock signal to the second gate driver by the signal controller.

The method may further include applying a data voltage to the data line during each scan period of the n first scan periods and the n second scan periods by the data driver and maintaining the data voltage applied to a pixel connected to the data line until a next scan period starts after the each scan period is finished.

The display device may further include a third gate driver, and the method may further include applying the gate-on voltage to a third gate line group among the plurality of gate lines in each period of n third scan periods for the first frame by the third gate driver.

In the method, the n first scan periods, the n second scan periods, and the n third scan periods may not overlap.

In the method each of the n first scan periods, each of the n second scan periods, and each of the n third scan periods may be respectively maintained during one scan time, and an interval between two adjacent scan periods of the n first scan periods, an interval between two adjacent scan periods of the n second scan periods, and an interval between two adjacent scan periods of the n third scan periods may be respectively a multiple of the one scan time.

In the method a ratio of the intervals between two start points of two adjacent scan periods among the n first scan periods does not have a multiple relationship.

In the method, when n is 3, a ratio of the intervals between the start points of neighboring scan periods of the n first scan periods is 1:3:7.

The method may further include outputting a first scanning start signal and a first gate clock signal to the first gate driver by the signal controller, outputting a second scanning start signal and a second gate clock signal to the second gate driver by the signal controller, and outputting a third scanning start signal and a third gate clock signal to the third gate driver by the signal controller.

In the method the data driver may further apply the data voltage having two or more levels to the data line.

The method may further include applying the gate-on voltage to the first gate line group, to the second gate line group, and to the third gate line group at the end of the first frame and applying a reset data voltage to the data line.

The method may further include applying a data voltage having two or more levels to the data line by the data driver.

According to an exemplary embodiment an electrowetting display device is provided. A display panel includes a plurality of pixels, each pixel having a reflecting electrode formed on a first substrate, a first transparent electrode positioned on the reflecting electrode, a hydrophobic insulating layer coated on the first transparent electrode, a first fluid and a second fluid formed on the hydrophobic insulating layer, the first fluid and the second fluid being materials that are not mixed and have different electrical conductivities. A first gate driver is configured to apply a gate-on voltage to gate lines of a first gate line group coupled to pixels in a first portion of the display panel in each period of n first scan periods for a first frame, n being a natural number. A second gate driver is configured to apply a gate-on voltage to gate lines of a second gate line group coupled to pixels in a second portion of the display panel in each period of n second scan periods for a first frame. A data driver is configured to apply a data voltage to a plurality of data lines coupled to respective ones of the pixels. A signal controller is configured to transmit a control signal to the first gate driver, to the second gate driver and to the data driver. An interval between start points of the n first scan periods is gradually decreased according to time, and an interval between start points of the n second scan periods is gradually increased according to time.

BRIEF DESCRIPTION OF THE DRAWINGS

FIG. 3 is a table of an application method of a data voltage according to an application method of a gate-on voltage according to the time division pulse width modulation driving method of two gate drivers shown in FIG. 2.

DETAILED DESCRIPTION

Figure 1:
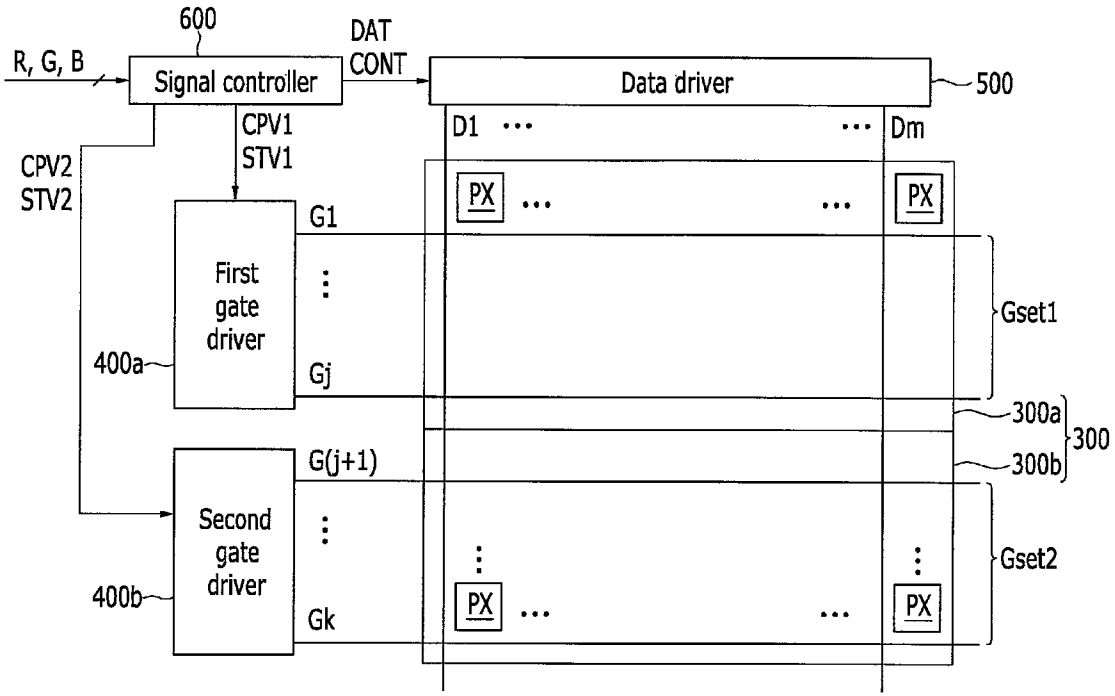
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, and the like, may be exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

A display device according to an exemplary embodiment of the present invention will now be described with reference to FIG. 1.

As shown in FIG. 1, a display device according to an exemplary embodiment of the present invention includes a display panel 300 and a first gate driver 400*a*, a second gate driver 400*b*, and a data driver 500 connected thereto, and a signal controller 600 that controls the first and second gate drivers 400*a*, 400*b* and the data driver 500.

The display panel 300 is divided into a first display panel part 300*a* and a second display panel part 300*b*, and includes a plurality of display signal lines G1-Gk, D1-Dm and a plurality of pixels PX connected thereto and arranged substantially as a matrix.

The display signal lines G1-Gk, D1-Dm include a plurality of gate lines G1-Gk that transmit a gate signal and a plurality of data lines D1-Dm that transmit a data voltage.

The gate lines G1-Gk are divided into a first gate line group Gset1 positioned in the first display panel part 300*a* and a second gate line group Gset2 positioned in the second display panel part 300*b*. The first gate line group Gset1 is connected to the first gate driver 400*a* and includes gate lines G1-Gj (j<k) sequentially arranged, and the second gate line group Gset2 is connected to the second gate driver 400*b* and includes gate lines G(j+1)-Gk sequentially arranged. The gate lines G1-Gk may intersect the data lines D1-Dm.

Each pixel PX includes a switching element connected to the display signal lines G1-Gk, D1-Dm and a pixel circuit connected thereto. The switching element as three terminal element, such as a thin film transistor (TFT), includes a control terminal connected to the gate lines G1-Gk, an input terminal connected to the data lines D1-Dm, and an output terminal connected to the pixel electrode. For color display, each pixel PX uniquely represents one of primary colors (i.e., spatial division) or each pixel PX sequentially represents the primary colors in turn (i.e., temporal division), such that a spatial or temporal sum of the primary colors is recognized as a desired color. An example of a set of the primary colors includes three primary colors of red, green, and blue colors. An example of a spatial division display may include a color filter representing one of the primary colors in an area corresponding to each pixel PX, and an example of a temporal division display may involves supplying light of the color changed according to the amount of time light is supplied by a backlight unit to each pixel PX.

The data driver 500 is connected to the data lines D1-Dm of the display panel 300 and applies the data voltage to the data lines D1-Dm.

The first gate driver 400*a* is connected to the gate lines G1-Gj of the first gate line group Gset1 and applies a scanning signal that is composed of a combination of a switch-on voltage Von to turn on the switching transistor and a switch-off voltage Voff to turn off the switching transistor to the gate lines G1-Gj.

The second gate driver 400*b* is connected to the gate lines G(j+1)-Gk of the second gate line group Gset2 and applies the gate signal to the gate lines G(j+1)-Gk.

The signal controller 600 controls the operation of the first and second gate drivers 400*a*, 400*b*, and the data driver 500.

Next, an operation of a display device will be described with reference to FIG. 2, FIG. 3, FIG. 4, FIG. 5, and FIG. 6 as well as FIG. 1.

FIG. 2, FIG. 4, FIG. 5, and FIG. 6 show an application method of a gate-on voltage according to a pulse width modulation driving method of a time division method of two gate drivers of a display device according to an exemplary embodiment of the present invention. FIG. 3 is a table of an application method of a data voltage according to an application method of a gate-on voltage according to the time division pulse width modulation driving method of two gate drivers shown in FIG. 2.

Referring back to FIG. 1, the signal controller 600 receives input image signals R, G, B and an input control signal from the outside. The input image signals R, G, B contain luminance information of each pixel PX, and the luminance has grays of a predetermined number, for example, $16=2^4$. The signal controller 600 properly processes the input image signals R, G, B on the basis of the input image signals R, G, B and the input control signals, and applies a data control signal CONT and processed image data DAT to the data driver 500 and a gate control signal to the first and second gate drivers 400*a*, 400*b*.

The gate control signal includes the first scanning start signal STV1 and at least one first gate clock signal CPV1 input to the first gate driver 400*a* and the second scanning start signal STV2 and at least one second gate clock signal CPV2 input to the second gate driver 400*b*. The first and second scanning start signals STV1, STV2 instruct a scan start of the gate-on voltage Von, and the first and second gate clock signals CPV1, CPV2 control output time of the gate-on voltage Von. Alternatively, the first and second gate drivers 400*a*, 400*b* may use the same gate clock signal CPV. That is, the first and second gate clock signals CPV1, CPV2 may be the same signal. The gate control signal may further include at least one output enable signal OE limiting the duration of the gate-on voltage Von.

Figure 2:
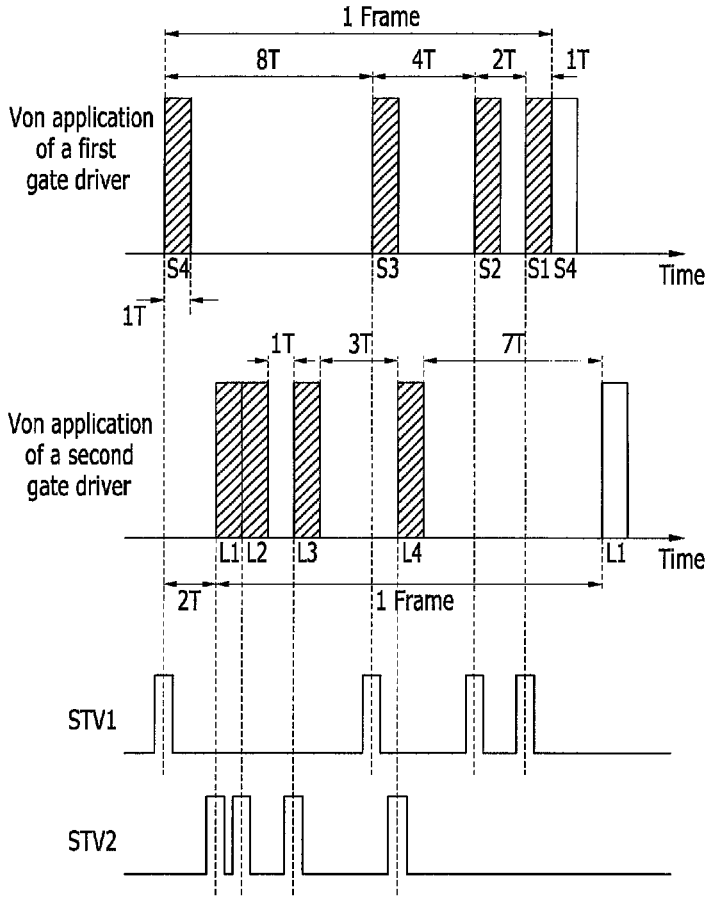
FIG. 2 depicts voltage/signal vs. time graphs of an application method of a gate-on voltage according to a time division pulse width modulation driving method of two gate drivers of a display device according to an exemplary embodiment of the present invention.

The first gate driver 400*a* and the second gate driver 400*b* sequentially apply the gate-on voltage Von to the gate line G1-Gj of the first gate line group Gset1 and the gate line G(j+1)-Gk of the second gate line group Gset2 n times during one frame to express the image of a $2^n$ gray (n is a natural number). The application of the gate-on voltage is processed according to the first and second scanning start signals STV1, STV2 and the first and second gate clock signals CPV1, CPV2 from the signal controller 600. Referring to FIG. 2, n (e.g., four) scan periods during one frame are started at an increasing time of the first and second gate clock signals CPV1, CPV2 during a time that the first and second scanning start signals STV1, STV2 are at a high level.

FIG. 2, FIG. 4, FIG. 5, and FIG. 6 are cases representing the image having a $2^4=16$ gray. According to the present exemplary embodiment, one frame may include four scan periods, and the scanning for the first gate line group Gset1 or the scanning for the second gate line group Gset2 is executed in each scan period. If the gate lines G1-Gj, G(j+1)-Gk are sequentially applied with the gate-on voltage, the switching element of the pixel PX connected to the gate lines G1-Gk is turned on and the data voltage applied to the data lines D1-Dm is applied to the corresponding pixel PX through the turned-on switching element.

The n (n=4 in FIG. 2) scan periods during one frame include the n-th scan period Sn, the (n−1)-th scan period S(n−1), . . . the first scan period S1, in the case of the first gate driver 400*a*, and the first scan period L1, the second scan period L2, . . . the n scan period Ln, in the case of the second gate driver 400*b*. Each scan period S1, S2, . . . , Sn, L1, L2, . . . , Ln has a scan time duration 1T.

Referring to FIG. 2, FIG. 4, FIG. 5, and FIG. 6, the temporal arrangement sequence of the n scan periods L1, L2, . . . , Ln for one frame of the second gate driver 400*b* according to an exemplary embodiment of the present invention is opposite to that of the first gate driver 400*a*. For example, the n scan periods Sn, S(n−1), . . . , S1 of one frame of the first gate driver 400*a* progress in the sequence of the n-th scan period Sn, the (n−1)-th scan periods (n−1), . . . , the second scan period S2, and the first scan period S1. However, the n scan periods L1, L2, . . . , Ln for one frame of the second gate driver 400*b* progress in the sequence of the first scan period L1, the second scan period L2, . . . , the (n−1)—the scan period L(n−1), and the n-th scan period Ln. That is, the pulse output sequence of the first scanning start signal STV1 each for the scan periods Sn, S(n−1), . . . , S1 input to the first gate driver 400*a* and the pulse output sequence of the second scanning start signal STV2 each for the scan periods L1, L2, . . . , Ln input to the second gate driver 400*b* are opposite to each other. Thus, according to this embodiment, the frequency of Von application is less during the early time period of the frame for the first gate driving, while the frequency of Von application is greater during the early time period of the frame for the second gate driver.

To display images having grays of a number of $2^n$ (e.g., 16) according to the time division pulse width modulation (PWM) method according to an exemplary embodiment of the present invention, the time between the end point of each scan period Sn, S(n−1), . . . , S1, L1, L2, . . . , Ln lasting 1 scan time 1T and the start point of the next scan period is different according to the position of the scan periods Sn, S(n−1), . . . , S1, L1, L2, . . . , Ln. For example, the interval between two adjacent scan periods of the n scan periods Sn, S(n−1), . . . , S1, L1, L2, . . . , Ln may be gradually increased or decreased.

For example, a temporal distance (referred to as "a data application and maintaining time" or "a sub-frame time" of each scan period) from the start point of the scan periods Sn, S(n−1), . . . , S2 to the start point of the next scan periods S(n−1), . . . , S1, Sn of the next frame in the case of the first gate driver 400*a* may be gradually decreased by ½ time such as $2^{(n-1)}T$, $2^{n-2}T$, . . . , $2^1T$, 1T. In the case of the second gate driver 400*b*, the temporal distance from the start point of the scan periods L1, L2, . . . , Ln to the start point of the next scan periods L2, . . . , Ln, L1 of the next frame may be gradually increased by 2 times such as 1T, $2^1T$, . . . , $2^{n-2}T$, $2^{(n-1)}T$. In other words, when a bit number of the image signal is n (the number of the gray of the image is $2^n$), a ratio of the temporal distance from the start point of the scan periods Sn, S(n−1), . . . , S2, L1, L2, . . . , Ln to the start point of the next scan periods S(n−1), . . . , S1, Sn of the next frame, L2, . . . , Ln, L1 of the next frame may be $1:2^1:\ldots:2^{n-2}:2^{(n-1)}$ as a ratio of a digit value of each bit of the n bits or may be opposite thereto. Accordingly, the entire length of one frame may be $2^{n-1}T$. However, the temporal distance between the scan periods Sn, S(n−1), . . . , S2, L1 L2, . . . , Ln is not limited thereto and may be vary.

The data voltage applied to the pixel PX is maintained before the start of the next scan period S(n−1), . . . , S1, Sn of the next frame, L2, . . . , Ln, L1 of the next frame after the finish of one scan period Sn, S(n−1), . . . , S1, L1, L2, . . . , Ln, and the maintaining of the data voltage may be realized by a maintaining means such as a storage capacitor.

According to an exemplary embodiment as shown in FIG. 3, the first data voltage (e.g., 30V) and the second data voltage (e.g., 0V) are applied at each scan period Sn, S(n−1), . . . , S1, L1, L2, . . . , Ln (n=4 in FIG. 3), thereby displaying the image having a $2^n$ (e.g., 16) gray. For example, when displaying the gray of 4 through four scan periods S1, S2, S3, S4, the first data voltage (e.g., 30V) is only applied in the third scan period S3, L3 and the second data voltage (e.g., 0V) is applied in the remaining scan periods S1, S2, S4, L1, L2, L4 such that the desired gray of the temporal sum or the average during one frame may be displayed. If the first data voltage is applied in each of scan periods Sn, S(n−1), . . . , S1, L1, L2, . . . , Ln, a white or a first color may be displayed, and if the second data voltage is applied, a black or a second color may be displayed. The first color and the second color may be different.

According to an exemplary embodiment of the present invention, the start point of the first scan period for one frame of the first and second gate drivers 400*a*, 400*b* for the scan period Sn, S(n−1), . . . , S1 of the first gate driver 400*a* and the scan periods L1, L2, . . . , Ln of the second gate driver 400*b* are not to overlapped.

Figure 4:
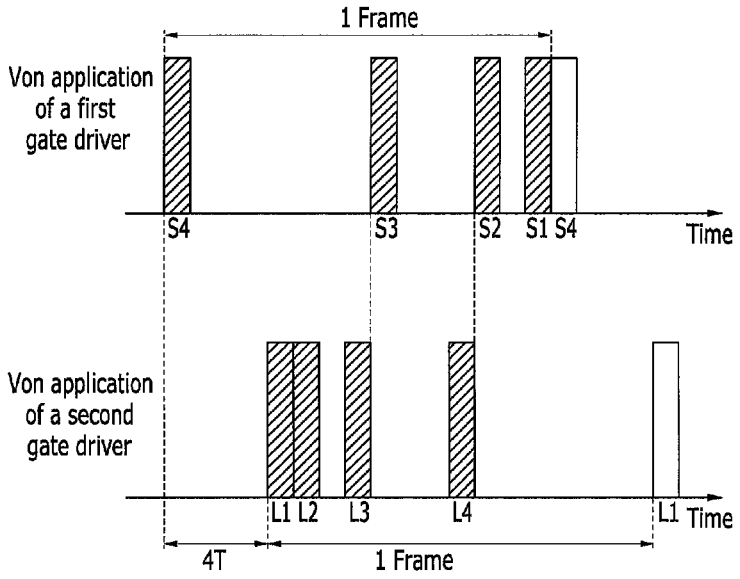
FIG. 4, FIG. 5, and FIG. 6 depict voltage/signal vs. time graphs of an application method of a gate-on voltage according to a time division pulse width modulation driving method of two gate drivers of a display device according to an exemplary embodiment of the present invention.

For example, in the exemplary embodiment shown in FIG. 2 and FIG. 4, the start point of the first scan period L1 as a first scan period for one frame of the second gate driver 400*b* is later than the start point of the fourth scan period S4 as the first scan period of the first gate driver 400*a*. In more detail, in the exemplary embodiment shown in FIG. 2, the temporal distance between the start point of the first scan period L1 as the first scan period for one frame of the second gate driver 400*b* and the start point of the fourth scan period S4 as the first scan period of the first gate driver 400*a* may be 2T. In the exemplary embodiment shown in FIG. 4, the temporal distance between the start point of the first scan period L1 as the first scan period for one frame of the second gate driver 400*b* and the start point of the fourth scan period S4 as the first scan period of the first gate driver 400*a* may be 4T.

Figure 5:
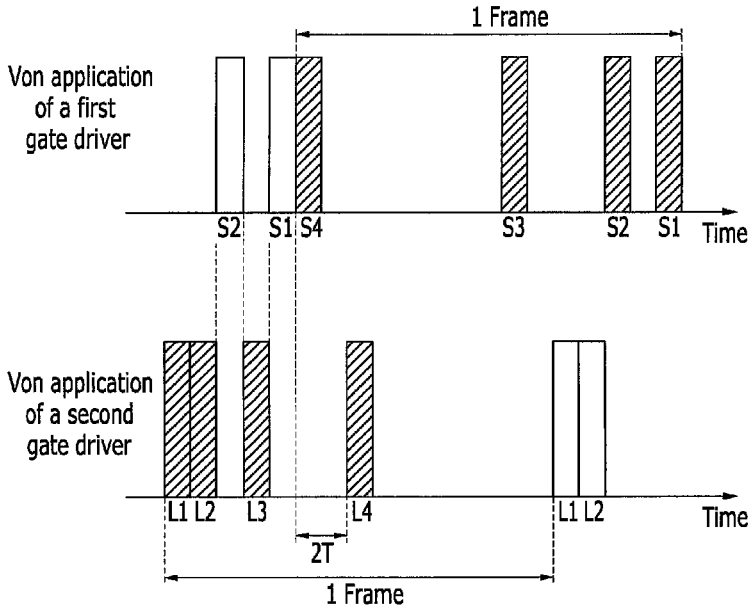
Figure 6:
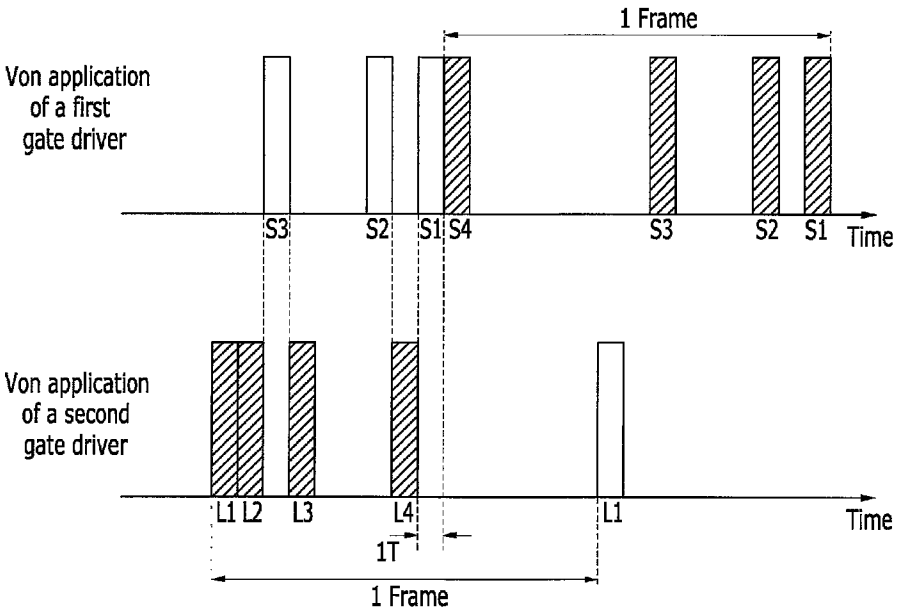

In the exemplary embodiments shown in FIG. 5 and FIG. 6, the start point of the first scan period L1 as the first scan period for one frame of the second gate driver 400*b* is earlier than the start point of the fourth scan period S4 as the first scan period of the first gate driver 400*a*. In more detail, in the exemplary embodiment shown in FIG. 5, the temporal distance between the start point of the first scan period L1 as the first scan period for one frame of the second gate driver 400*b* and the start point of the fourth scan period S4 as the first scan period of the first gate driver 400*a* may be 5T. In the exemplary embodiment of FIG. 6, the temporal distance between the start point of the first scan period L1 as the first scan period for one frame of the second gate driver 400*b* and the start point of the fourth scan period S4 as the first scan period of the first gate driver 400*a* may be 9T.

On the other hand, if a time from the start point of the first scan period Sn of the first gate driver 400*a* to the finish time of scan period S1 is referred to as 1 frame time 1F, the temporal difference between the start point of the first scan period L1 for the first frame of the second gate driver 400*b* and the start point of the first scan period Sn for the first frame of the first gate driver 400*a* may be smaller than 1 frame time 1F.

As described above, according to an exemplary embodiment of the present invention, when the display device is driven by the time division pulse width modulation (PWM) method by using two gate drivers 400*a*, 400*b*, the arrangement sequence of the n scan periods for one frame of the second gate driver 400*b* among two gate drivers 400*a*, 400*b* and the arrangement sequence of the n scan periods for one frame of the first gate driver 400*a* are opposite to each other and the start point of the n scan periods for one frame for the scan periods of two gate drivers 400*a*, 400*b* are not overlapped such that the total time to display the image of one frame may be reduced. That is, a total idle time of two gate drivers 400*a*, 400*b* may be reduced.

Accordingly, according to an exemplary embodiment of the present invention, the entire driving time for applying the gate-on voltage to the gate lines G1-Gk of the entire display panel 300 may be reduced by about half and the driving frequency may be increased by about two times compared with a case that the n scan periods of two gate driver 400*a*, 400*b* are the same. Also, in the case that the driving frequency is not increased, the application time of the gate-on voltage may be increased such that the charging time of the data voltage for the pixel PX may be increased.

In the exemplary embodiment shown in FIG. 2, FIG. 4, FIG. 5, and FIG. 6, the arrangement sequence of the n scan periods of the first gate driver 400*a* and the second gate driver 400*b* may be reversed. Namely, the arrangement sequence of the n scan periods of the first gate driver 400*a* is that of the second gate driver 400*b* while the arrangement sequence of the n scan periods of the second gate driver 400*b* is that of the first gate driver 400*a*.

Next, a display device according to an exemplary embodiment of the present invention will be described with reference to FIG. 7 and FIG. 8.

Figure 7:
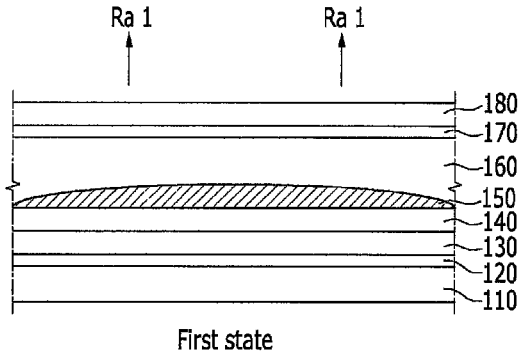
FIG. 7 is a cross-sectional view of an electrowetting display according to an exemplary embodiment of the present invention in a first state in which a pixel electrode is not applied with a voltage.
Figure 8:
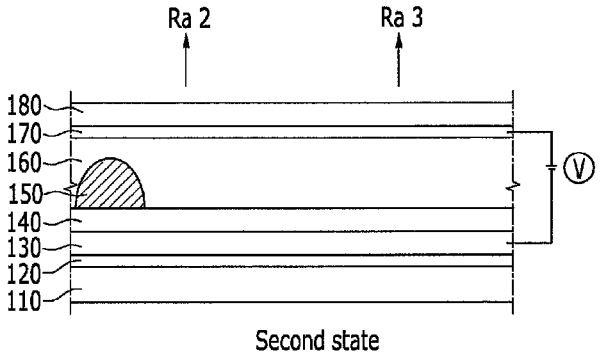
FIG. 8 is a cross-sectional view of an electrowetting display device according to an exemplary embodiment of the present invention in the second state in which a pixel electrode is applied with a voltage.

FIG. 7 is a cross-sectional view of an electrowetting display according to an exemplary embodiment of the present invention in the first state in which a pixel electrode is not applied with a voltage, and FIG. 8 is a cross-sectional view of an electrowetting display device according to an exemplary embodiment of the present invention in the second state in which a pixel electrode is applied with a voltage.

Electrowetting is the modification of the wetting properties of a surface which is typically hydrophobic, i.e., the physical property of a molecule that is repelled from a mass of water, with an applied electric field. Electrowetting allows large numbers of material droplets to be independently manipulated under direct electrical control without the use of external pumps, valves or even fixed channels. Such manipulation can provide varying light transmission characteristics for the display device.

Referring to FIG. 7, in an electrowetting display device according to an exemplary embodiment of the present invention, a reflecting electrode 120 that may be made of a metal such as aluminum (Al) is formed on a first substrate 110 made of glass or plastic. A first transparent electrode 130 made of a transparent conductive material such as ITO and IZO is positioned on the reflecting electrode 120, and a hydrophobic insulating layer 140 is coated thereon. Although not shown, a partition (not shown) dividing each pixel PX is formed on the hydrophobic insulating layer 140. A first fluid 150 and a second fluid 160 are formed on the hydrophobic insulating layer 140 of each pixel PX. The first fluid 150 and the second fluid 160 may be made of materials that are not mixed, and may have different electrical conductivities or polarities. For example, the first fluid 150 may have an electrical insulating property and the second fluid 160 may have an electrical conductivity property. The second fluid 160 having the electrical conductivity property may be an electrolyte solution, and water may be used as a solvent. The first fluid 150 may be oil having an electric insulating characteristic while not being mixed with the second fluid 160. The first fluid 150 may have the first color (e.g., a black color), and the second fluid 160 may be transparent. The second fluid 160 is covered by a second substrate 180 facing the first substrate 110, and a second transparent electrode 170 made of the transparent conductive material such as ITO and IZO is formed on the second substrate 180. Accordingly, the second fluid 160 contacts the second transparent electrode 170.

FIG. 7 shows a first state in which the voltage is not applied to the first transparent electrode 130 and the second transparent electrode 170 of the electrowetting display device according to an exemplary embodiment of the present invention. Here, the first fluid 150 having the first color covers most of each pixel PX such that light incident from the outside is reflected from the reflecting electrode 120, thereby being light Ra1 having the first color.

FIG. 8 shows the second state in which the voltage is applied to the first transparent electrode 130 and the second transparent electrode 170 of the electrowetting display device according to an exemplary embodiment of the present invention. At this time, the first fluid 150 having the first color is pushed to the edge of the pixel PX and the light reflected from the reflecting electrode 120 is mostly passed through the portion where the first fluid 150 does not exist, thereby being light Rat having the second color. The second color may be the same as the color of the light incident to the reflecting electrode 120 and may be the same as the color of a color filter (not shown). When the electrowetting display device according to an exemplary embodiment of the present invention includes the color filter, the color filter may be positioned on the first substrate 110 or the second substrate 180.

In the exemplary embodiment shown in FIG. 7 and FIG. 8, the reflecting electrode 120 may be omitted, and in this case, the display device according to the present exemplary embodiment is a transmissive display device, wherein an inner light source (not shown) is positioned under the first substrate 110 such that the light is supplied to the first substrate 110. In this case, the second color is the same as the color of the light emitted from the inner light source when the color filter is not present. Also, the second color may be the same as the color of the color filter when the color filter (not shown) is present and the color of the light of the inner light source is white.

Also, a portion of the light passing outside may be passed through the first fluid 150 that is pushed to one side of the pixel PX, and in this case, the color of the light passing through the first fluid 150 may be the same as the color of the first color of the first fluid 150 and may have high saturation.

As described above, as the display device according to an exemplary embodiment of the present invention, the electrowetting display device includes the pixel electrode made of the first and second transparent electrodes 130 and 170 positioned in each pixel PX, and thereby the first state and the second state are respectively defined when the pixel electrode is not applied with the voltage and is applied with the voltage. The first state may display the black, and the second state may display the white.

The electrowetting display device according to an exemplary embodiment of the present invention may be driven by the driving method according to the exemplary embodiment shown in FIG. 1 to FIG. 6, and in this case, the first state may be the case that the second data voltage (e.g., 0V) is applied, and the second state may be the case that the first data voltage (e.g., 30V) is applied.

The electrowetting display device according to an exemplary embodiment of the present invention may have a characteristic that the first fluid 150 is backflowed into an original position although the voltage applied to the first and the second transparent electrodes 130, 170 is maintained after the first fluid 150 is pushed to one side of the pixel PX. To prevent this, the first and second gate drivers 400*a*, 400*b* may have an additional scan period as well as the n scan periods Sn, S(n−1), . . . , S1, L1, L2, . . . , Ln. This will be described with reference to FIG. 9 as well as FIG. 1 to FIG. 6.

Figure 9:
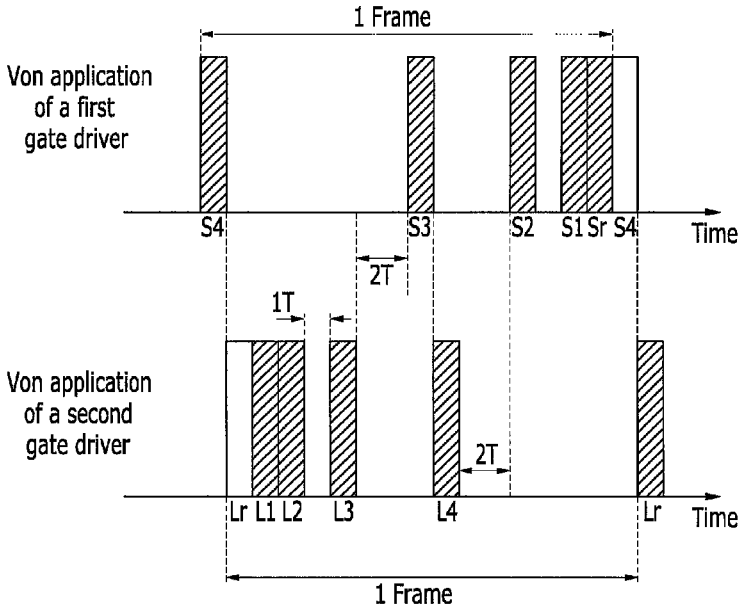
FIG. 9 depicts voltage/signal vs. time graphs of an application method of a gate-on voltage according to a time division pulse width modulation driving method of two gate drivers of an electrowetting display device according to an exemplary embodiment of the present invention.

FIG. 9 is a graph depicting of an application method of a gate-on voltage according to a time division pulse width modulation driving method of two gate drivers of an electrowetting display device according to an exemplary embodiment of the present invention.

A driving method according to an exemplary embodiment shown in FIG. 9 is the almost the same as the driving method according to the exemplary embodiment shown in FIG. 2, FIG. 4, FIG. 5, and FIG. 6. However, the scan period of one frame of the first gate driver 400*a* and the second gate driver 400*b* in the exemplary embodiment shown in FIG. 9 may further include reset scan periods Sr, Lr (n=4 in FIG. 9) at the end of each frame as well as the n-th scan periods Sn, Ln, the (n−1)-th scan periods S(n−1), L(n−1), . . . the first scan periods S1, L1. The reset scan periods Sr, Lr may be maintained during 1 scan time 1T like the first scan periods S1, L1, and may be progressed directly after the finish of the first scan periods S1, L1 or before the start thereof.

The data voltage applied to the data lines D1-Dm during the reset scan periods Sr, Lr as a reset data voltage may be equal to or different from the first data voltage (e.g., 30V). If the reset data voltage is applied to all pixels PX through the data lines D1-Dm during the reset scan periods Sr, Lr, the backflow of the pushed first fluid 150 may be prevented.

Also, the driving method according to the exemplary embodiment shown in FIG. 9 may have various characteristics of the driving method according to the exemplary embodiment shown in FIG. 2 to FIG. 6.

According to another exemplary embodiment of the present invention, in the time division pulse width modulation driving method according to the above-described exemplary embodiments, the data voltage applied to the pixel PX during each scan period is not limited to two values of the first data voltage (e.g., 30V) and the second data voltage (e.g., 0V) and may have one among three or more values. For example, the data voltage may have seven values such as −15V, −10V, −5V, 0V, 5V, 10V, and 15V. As described above, the driving method displaying the different grays by varying the size of the data voltage is referred to as a pulse amplitude modulation method. Accordingly, in the driving method of the display device according to the several exemplary embodiment of the present invention, if the gray is displayed by varying three or more magnitudes of the data voltage, the pulse width modulation method and the pulse amplitude modulation method may be used together such that the number of grays of the image to be displayed may be further increased. In other words, the gray of the image displayed by the pixel PX is proportional to the product of the applied data voltage and the time that the data voltage is applied and maintained, that is, the data application and maintaining time or the sub-frame time, such that the gray range may be further increased. However, in the exemplary embodiment shown in FIG. 1 to FIG. 9, when the data application and maintaining time or the sub-frame time of the scan periods Sn, S(n−1), . . . , S1, L1, L2, . . . , Ln depends on a geometric series such as $1:2:2^2$, . . . or a opposite order, the number of grays proportional to the product of the sub-frame time and the application data voltage may be limited.

For example, if four data voltages are applied to the pixel PX, such as 0V, 5V, 10V, or 15V, and the data application and maintaining is expressed as $2^n$ (n=0, 1, 2, . . . ), the gray expressed when the applied data voltage is 20V and the data application and maintaining time of the scan period is $2^0=1$ and the gray expressed when the applied data voltage is 10V and the data application and maintaining time of the scan period is $2^1$ may be the same.

A driving method of a display device according to another exemplary embodiment of the present invention will be described with reference to FIG. 10 and FIG. 11, and the above FIG. 7 to FIG. 9. Like reference numerals designate like elements in the embodiment and the same description will be omitted.

Figure 10:
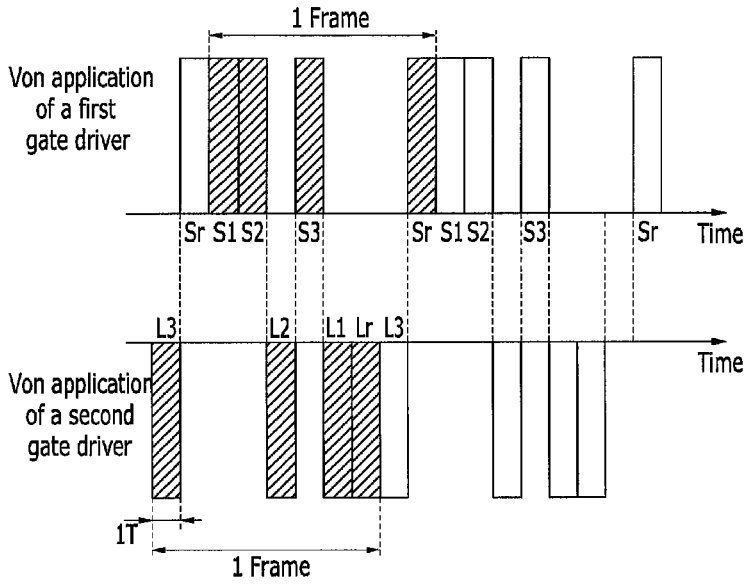
FIG. 10 depicts voltage/signal vs. time graphs of an application method of a gate-on voltage according to a time division pulse width modulation driving method of two gate drivers of a display device according to an exemplary embodiment of the present invention.
Figure 11:
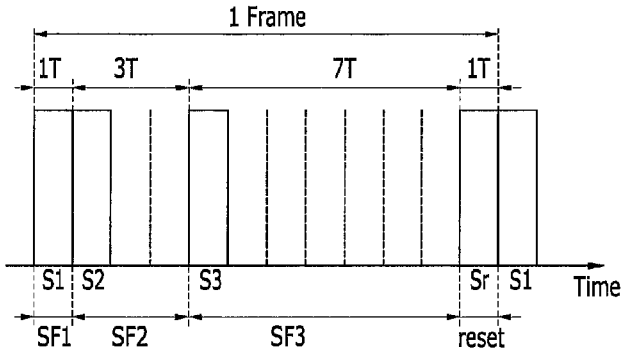
FIG. 11 depicts a scan voltage/signal vs. time graph of an application method of a gate-on voltage according to a time division pulse width modulation driving method of a gate driver of a display device according to an exemplary embodiment of the present invention.

FIG. 10 shows graphs depicting of an application method of a gate-on voltage according to a time division pulse width modulation driving method of two gate drivers of a display device according to an exemplary embodiment of the present invention, and FIG. 11 is a graph depicting an application method of a gate-on voltage according to a time division pulse width modulation driving method of a gate driver of a display device according to an exemplary embodiment of the present invention.

The driving method shown in FIG. 10 is substantially the same as the driving method shown in FIG. 9. However, in an exemplary embodiment one frame of the first gate driver 400*a* and the second gate driver 400*b* includes three scan periods S1, S2, S3 and one reset scan period Sr for the first gate driver 400*a* and three scan periods L1, L2, L3 and one reset scan period Lr for the second gate driver 400*b*. In the present exemplary embodiment, the reset scan periods Sr, Lr may be maintained during 1 scan time 1T as the first scan period S1, L1, and may be directly after the finish of the first scan period S1, L1 or before the start thereof. While a reset scan period Sr, Lr may be omitted, in the present exemplary embodiment, the reset scan period is in addition to three scan periods S1, S2, S3, L1, L2, L3 of the first and second gate drivers 400*a*, 400*b*.

Also, in the exemplary embodiment shown in FIG. 10, the arrangement sequence of the scan periods S1, S2, S3 for the first gate driver 400*a* and the arrangement sequence of the scan periods L3, L2, L1 for the second gate driver 400*b* may be opposite to that shown in FIG. 9. That is, in the exemplary embodiment shown in FIG. 10, the temporal distance between the scan periods S1, S2, S3 for the first gate driver 400*a* may be gradually increased and the temporal distance between the scan periods L3, L2, L1 for the second gate driver 400*b* may be gradually decreased.

According to the driving method shown in FIG. 10, the start point of the third scan period L3 as the first scan period for one frame of the second gate driver 400*b* is earlier than the start point of the first scan period S1 as the first scan period of the first gate driver 400*a*. In more detail, the start point of the third scan period L3 of the second gate driver 400*b* may be earlier than the start point of the first scan period S1 of the first gate driver 400*a* by 2T.

Referring to FIG. 11, the intervals between two adjacent scan periods of the scan periods S1, S2, S3 and the reset scan period S4 during one frame of the first gate driver 400*a* or the second gate driver 400*b* as the gate driver of the display device according to an exemplary embodiment of the present invention is different from the exemplary embodiment shown in FIG. 10.

The duration of the first scan period S1 of the gate driver is referred to as the first sub-frame time SF1. A time interval between the start point of the second scan period S2 and the start point of the third scan period S3 is referred to as the second sub-frame time SF2. The time interval between the start point of the third scan period S3 and the start point of the reset scan period Sr is referred to as the third sub-frame time SF3. The duration of the reset scan period Sr is referred to as a reset time reset.

In the exemplary embodiment shown in FIG. 11, the ratio of the first, second, and third sub-frame times SF1, SF2, SF3 may be a number that is not a multiple. For example, the ratio of the first, second, and third sub-frame times SF1, SF2, SF3 may be 1:3:7. That is, when the duration of the scan periods S1, S2, S3, and the reset scan period S4 is referred to as 1T, the first sub-frame time SF1 may be 1T, the second sub-frame time SF2 may be 3T, the third sub-frame time SF3 may be 7T, and the reset time reset may be 1T. When a scan period is added, the sub-frame time may be the ratio including the number that is not a multiple such as 1:3:7:9.

As described above, when the ratio of the sub-frame time related to scan periods S1, S2, S3 is not a multiple or a sub-multiple such as 1:3:7 . . . , the number of grays under the driving of the pulse amplitude modulation method may be further increased. For example, when considering the data voltages of 5V, 10V, and 15V, a gray proportional to the product of the sub-frame time and the data voltage may have different values except for the case that the sub-frame time is 1k (k is natural number) and the data voltage is 15V and the case that the sub-frame time is 3k and the data voltage is 5V. In contrast, when the ratio of the sub-frame has a geometric series such as 1:2:4 . . . , an overlapping gray is generated such that the number of grays to be expressed is less than the exemplary embodiment shown in FIG. 11.

By controlling the data voltage, the number of grays to be expressed in the exemplary embodiment shown in FIG. 11 may be further increased.

The various characteristics of the exemplary embodiment shown in FIG. 9 may be equally applied to the exemplary embodiments shown in FIG. 10 and FIG. 11.

Next, a display device according to another exemplary embodiment of the present invention will be described with reference to FIG. 12. Like reference numerals designate the same elements as in the exemplary embodiment of FIG. 1, and the same descriptions will be omitted.

Figure 12:
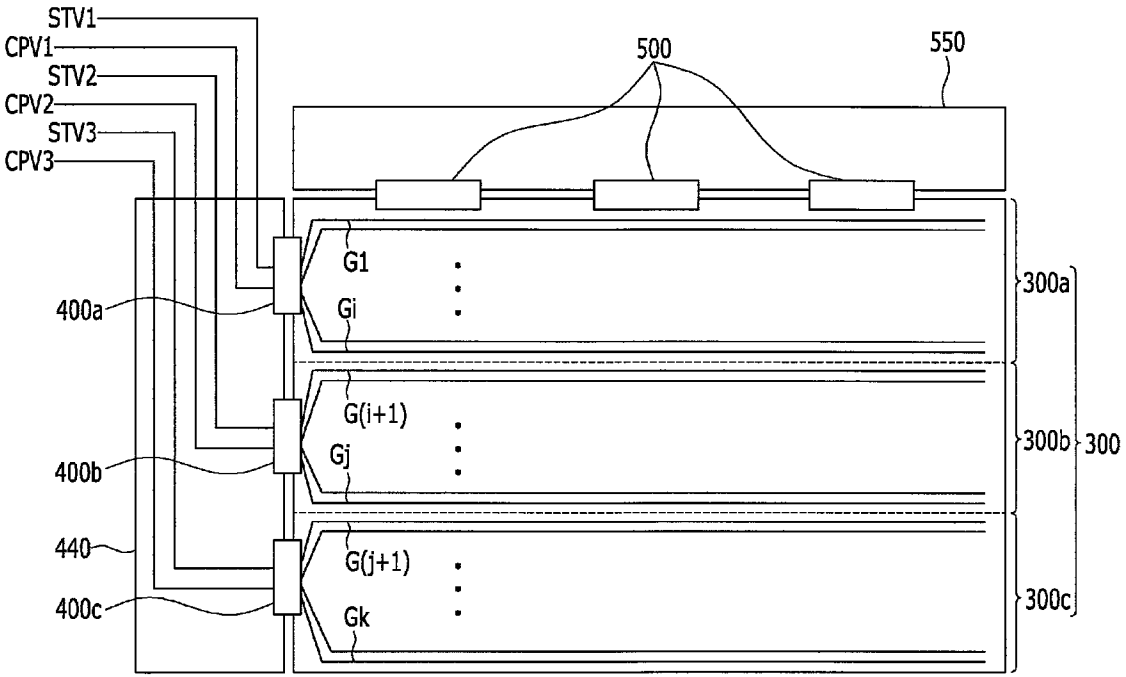
FIG. 12 is a block diagram of a display device according to an exemplary embodiment of the present invention.

FIG. 12 is a block diagram of a display device according to an exemplary embodiment of the present invention.

Referring to FIG. 12, a display device according to an exemplary embodiment of the present invention includes a display panel 300 and a plurality of gate drivers and at least one data driver 500 connected thereto.

In the exemplary embodiment of FIG. 12, a plurality of gate drivers include a first gate driver 400*a*, a second gate driver 400*b*, and a third gate driver 400*c*. However, the number of gate drivers is not limited thereto.

The display panel 300 may be divided into a plurality of display panel parts according to the number of gate drivers. For example, as shown in FIG. 12, the display panel 300 may be divided in a first display panel part 300*a*, a second display panel part 300*b*, and a third display panel part 300*c*. The display panel parts 300*a*, 300*b*, 300*c* respectively include a plurality of display signal lines and a plurality of pixels connected thereto and arranged in the approximately matrix. The display signal lines include a plurality of gate lines G1-Gk that transmit a gate signal and a plurality of data lines (not shown) that transmit a data voltage.

In the exemplary embodiment shown in FIG. 12, all gate lines G1-Gk may be divided into a first gate line group G1, . . . , Gi positioned at the first display panel part 300*a*, a second gate line group G i+1, . . . , Gj positioned at the second display panel part 300*b*, and a third gate line group G(j+1), . . . , Gk positioned at the third display panel part 300*c*. The first gate line group G1, . . . , Gi is connected to the first gate driver 400*a*. The second gate line group G i+1, . . . , Gj is connected to the second gate driver 400*b*. The third gate line group G(j+1), . . . , Gk is connected to the third gate driver 400*c*. The detailed description for the pixel, the data driver, and the first, second, and third gate drivers 400*a*, 400*b*, 400*c* connected to the gate lines G1-Gk and the data lines is the same as that of the exemplary embodiment shown in FIG. 1 and is therefore omitted.

The first, second, and third gate drivers 400*a*, 400*b*, 400*c* are connected to the signal transmitting lines provided in a printed circuit board (PCB) 440 for receiving gate control signals, and a data driver 500 is connected to the signal transmitting lines provided in a printed circuit board (PCB) 550 for receiving the data control signals. These gate control signals and data control signals may be transmitted from the signal controller 600 shown in FIG. 1.

The gate control signal includes a first scanning start signal STV1 and at least one first gate clock signal CPV1 input to the first gate driver 400*a*, a second scanning start signal STV2 and at least one second gate clock signal CPV2 input to the second gate driver 400*b*, and a third scanning start signal STV3 and at least one third gate clock signal CPV3 input to the third gate driver 400*c*. Like the exemplary embodiment shown in FIG. 2, the pulses of the first, second, and third scanning start signals STV1, STV2, STV3 transmitted to the first, second, and third gate drivers 400*a*, 400*b*, 400*c* may not be overlapped. Accordingly, the first, second, and third gate drivers 400*a*, 400*b*, 400*c* may transmit the gate-on voltage Von to the gate lines G1-Gk at different times according to the first, second, and third scanning start signals STV1, STV2, STV3.

Next, the operation of the display device shown in FIG. 12 will be described with reference to FIG. 13 as well as FIG. 12. Like reference numerals designate like elements in the embodiment and the same descriptions will be omitted.

Figure 13:
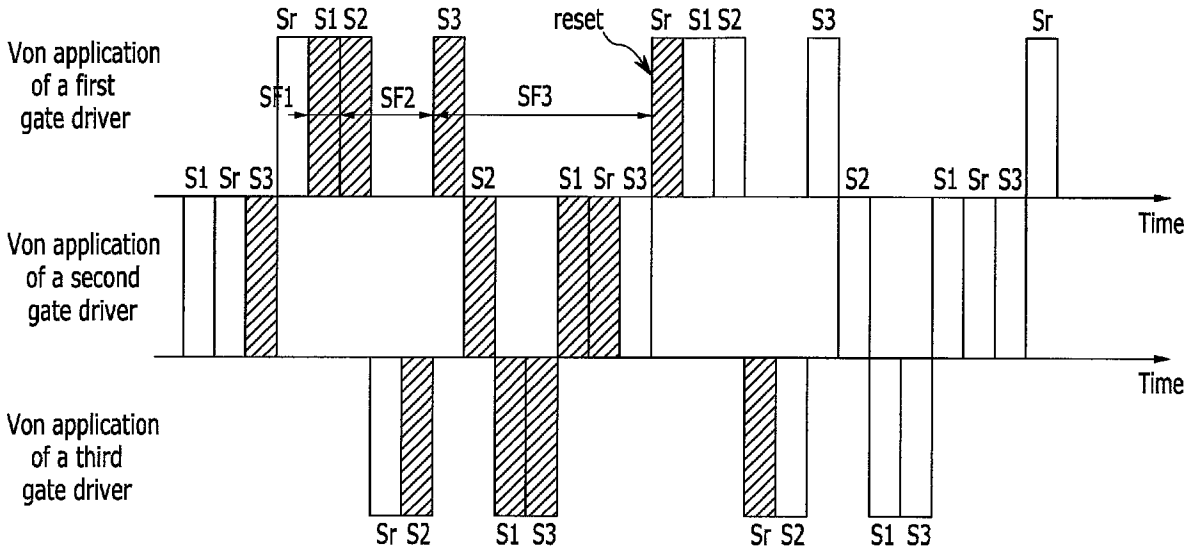
FIG. 13 depicts voltage/signal vs. time graphs of an application method of a gate-on voltage according to a pulse width modulation driving method of three gate drivers of a display device according to an exemplary embodiment of the present invention.

FIG. 13 is a graph depicting an application method of a gate-on voltage according to pulse width modulation driving method of three gate drivers of a display device according to an exemplary embodiment of the present invention.

In the exemplary embodiment shown in FIG. 13, the first gate driver 400*a*, the second gate driver 400*b*, and the third gate driver 400*c* sequentially apply the gate-on voltage Von to the gate lines G1-Gk respectively connected thereto n times (e.g., three times) during one frame. When one frame includes the reset scan period Sr, the first, second, and third gate drivers 400*a*, 400*b*, 400*c* sequentially apply the gate-on voltage Von to the gate lines G1-Gk respectively connected thereto n+1 times. That is, the first, second, and third gate drivers 400*a*, 400*b*, 400*c* may apply the gate-on voltage Von to all gate line groups connected thereto during each scan period S1, S2, S3.

The ratio of the first sub-frame time SF1 which is the time interval between the start point of the first scan period S1 and the start point of the following scan period, the second sub-frame time SF2 which is the time interval between the start point of the second scan period S2 and the start point of the following scan period, and the third sub-frame time SF3 which is the time interval between the start point of the third scan period S3 and the following scan period may be gradually increased. The ratio may be constituted by numbers that do not have a multiple relationship, such as 1:3:7.

Referring to FIG. 13, the scan periods S1, S2, S3 and the reset scan period Sr of the first, second, and third gate drivers 400*a*, 400*b*, 400*c* according to an exemplary embodiment of the present invention do not temporally overlap. For this, the arrangement sequence of each scan period S1, S2, S3 of the first, second, and third gate drivers 400*a*, 400*b*, 400*c* may be different.

For example, as shown in FIG. 13, in the case of the first gate driver 400*a*, the first scan period S1, the second scan period S2, the third scan period S3, and the reset scan period Sr may be temporally included in order during one frame. In the second gate driver 400*b*, the third scan period S3, the second scan period S2, the first scan period S1, and the reset scan period Sr may be temporally included in order during one frame. In the case of the third gate driver 400*c*, the second scan period S2, the first scan period S1, the third scan period S3, and the reset scan period Sr may be temporally included in order during one frame. Each scan period S1, S2, S3, and the reset scan period Sr is maintained during 1 scan time 1T.

If the gate-on voltage Von is applied to the gate lines G1-Gk in each scan period S1, S2, S3 and the reset scan period Sr, the data voltage is applied to the switching element of the pixel connected to the gate lines G1-Gk such that the corresponding data voltage is applied to the pixel. To express many grays, the display device may be driven with the pulse amplitude modulation method by configuring three or more levels of the data voltage.

As set forth in the exemplary embodiments of the present invention, for the driving method for the time division pulse width modulation method, if the temporal intervals between the several sequential scan periods of a plurality of gate drivers are appropriately controlled, three or more gate drivers may be used. That is, as shown in FIG. 11, if the intervals between the start points of adjacent scan periods S1, S2, S3 during one frame is appropriately controlled such as 1:3:7, three gate driver 400*a*, 400*b*, 400*c* may be used such that the display resolution may be further increased by 50% as compared with the exemplary embodiments using two gate drivers 400*a*, 400*b*.

In the several exemplary embodiments of the present invention, an electrowetting display device is provided as an example of the display device. However, it is not limited thereto, and the present invention may be applied to various display devices that may be driven by the driving method of the time division pulse width modulation method according to an exemplary embodiment of the present invention, for example, a display device using microelectromechanical systems (MEMS) or a cholesteric liquid crystal display.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel including a plurality of pixels, a plurality of gate lines, and a plurality of data lines;

a first gate driver configured to apply gate-on voltages to gate lines of a first gate line group among the plurality of gate lines in each period of n first scan periods for a first frame, n being a natural number;

a second gate driver configured to apply gate-on voltages to gate lines of a second gate line group among the plurality of gate lines in each period of n second scan periods for a first frame;

a data driver configured to apply a data voltage to a plurality of data lines; and a signal controller configured to transmit a control signal to the first gate driver, the second gate driver and the data driver, wherein an interval between start points of the n first scan periods is gradually decreased according to time, and an interval between start points of the n second scan periods is gradually increased according to time.

2. The display device of claim 1, wherein the n first scan periods and the n second scan periods are not overlapped with each other.

3. The display device of claim 2, wherein a temporal difference between a start point of the first scan period among the n first scan periods for the first frame and a start point of the first scan period among the n second scan periods for the first frame is smaller than one frame.

4. The display device of claim 3, wherein: each of the n first scan periods and each of the n second scan periods are maintained during one scan time, and an interval between two adjacent scan periods of the n first scan periods and an interval between two adjacent scan periods of the n second scan periods are respectively maintained during one scan time, and the interval of the n first scan period and the interval between the n second scan periods are a multiple of the one scan time.

5. The display device of claim 4, wherein an interval between start points of neighboring scan periods of the n first scan periods is decreased by 1/k according to time, and an interval between start points of neighboring scan periods of the n second scan periods is increased by a k, according to time, k being a natural number.

6. The display device of claim 2, wherein a start point of the first scan period of the n first scan periods is earlier than a start point of the first scan period of the n second scan periods.

7. The display device of claim 2, wherein a start point of the first scan period of the n first scan periods is later than a start point of the first scan period of the n second scan periods.

8. The display device of claim 2, wherein the signal controller outputs a first scanning start signal and a first gate clock signal to the first gate driver, and a second scanning start signal and a second gate clock signal to the second gate driver.

9. The display device of claim 8, wherein an output sequence of first pulses of the first scanning start signal, each first pulse corresponding to the n respective first scan periods, is opposite to an output sequence of second pulses of the second scanning start signal, each second pulse corresponding to the respective n second scan periods.

10. The display device of claim 8, wherein the first gate clock signal is the same as the second gate clock signal.

11. The display device of claim 2, wherein a data voltage applied to a pixel during each scan period of the n first scan periods and the n second scan periods is maintained until a next scan period starts after the each scan period is finished.

12. The display device of claim 1, wherein the signal controller outputs a first scanning start signal and a first gate clock signal to the first gate driver, and a second scanning start signal and a second gate clock signal to the second gate driver.

13. The display device of claim 1, further comprising a third gate driver configured to apply the gate-on voltage to gate lines of a third gate line group among the plurality of gate lines in each period of n third scan periods for the first frame.

14. The display device of claim 13, wherein the n first scan periods, the n second scan periods, and the third scan periods do not overlap.

15. The display device of claim 14, wherein: each of the n first scan periods, each of the n second scan periods, and each of the n third scan periods are respectively maintained during one scan time, and an interval between two adjacent scan periods of the n first scan periods, an interval between two adjacent scan periods of the n second scan periods, and an interval between two adjacent scan periods of the n third scan periods are respectively a multiple of the one scan time.

16. The display device of claim 15, wherein a ratio of intervals between two start points of two adjacent scan periods among the n first scan periods does not have a multiple relationship.

17. The display device of claim 16, wherein when a is 3, a ratio of the intervals between the start points of neighboring scan periods of the n first scan periods is 1:3:7.

18. The display device of claim 16, wherein the signal controller outputs a first scanning start signal and a first gate clock signal to the first gate driver, a second scanning start signal and a second gate clock signal to the second gate driver, and a third scanning start signal and a third gate dock signal to the third gate driver.

19. The display device of claim 1, wherein the display device comprises an electrowetting display device.

20. The display device of claim 1, wherein a reset scan period is in the first frame.

21. The display device of claim 1, wherein the data voltage has two or more values.

22. A method for driving a display device including a display panel having a plurality of pixels coupled to a plurality of gate lines and to a plurality of data lines, a first gate driver and a second gate driver coupled to the gate lines, a data driver coupled to the data lines, and a signal controller configured to provide control signals to the first and second gate drivers and to the data driver, the method comprising:

applying gate-on voltages to a first gate line group among the plurality of gate lines in each period of n first scan periods for a first frame by the first gate driver, n being a natural number; and applying gate-on voltages to a second gate line group among the plurality of gate lines in each period of n second scan periods for the first frame by the second gate driver, wherein an interval between start points of the n first scan periods is gradually decreased according to time, and an interval between start points of the n second scan periods is gradually increased according to time.

23. The method of claim 22, wherein the n first scan periods and the n second scan periods are not overlapped with each other.

24. The method of claim 23, wherein a temporal difference between a start point of the first scan period among the n first scan periods for the first frame and a start point of the first scan period among the n second scan periods for the first frame is smaller than one frame.

25. The method of claim 24, wherein each of the n first scan periods and each of the n second scan periods are maintained during one scan time, and an interval between two adjacent scan periods of the n first scan period and an interval between two adjacent scan periods of the n second scan periods are respectively a multiple of the one scan time.

26. The method of claim 25, wherein:

an interval between start points of neighboring scan periods of the n first scan periods is decreased by 1/k according to time, k being a natural number, and an interval between start points of neighboring scan periods of the n second scan periods is increased by k according to time.

27. The method of claim 23, wherein a start point of the first scan period of the n first scan periods is earlier than a start point of the first scan period of the n second scan periods.

28. The method of claim 23, wherein a start point of the first scan period of the n first scan periods is later than a start point of the first scan period of the n second scan periods.

29. The method of claim 23, further comprising:

outputting a first scanning start signal and a first gate clock signal to the first gate driver by the signal controller, and outputting a second scanning start signal and a second gate clock signal to the second gate driver by the signal controller.

30. The method of claim 22, further comprising:

applying a data voltage to the data line during each scan period of the n first scan periods and the n second scan periods by the data driver; and maintaining the data voltage applied to a pixel connected to the data line until a next scan period starts after the each scan period is finished.

31. The method of claim 22, wherein: the display device further comprises a third gate driver, and the method further comprises applying the gate-on voltage to a third gate line group among the plurality of gate lines in each period of n third scan periods for the first frame by the third gate driver.

32. The method of claim 31, wherein the n first scan periods, the n second scan periods, and the n third scan periods do not overlap.

33. The method of claim 32, wherein: each of the n first scan periods, each of the n second scan periods, and each of the n third scan periods are respectively maintained during one scan time, and an interval between two adjacent scan periods of the n first scan periods, an interval between two adjacent scan periods of the n second scan periods, and an interval between two adjacent scan periods of the n third scan periods are respectively a multiple of the one scan time.

34. The method of claim 33, wherein a ratio of the intervals between two start points of two adjacent scan periods among the n first scan periods does not have a multiple relationship.

35. The method of claim 34, wherein when n is 3, a ratio of the intervals between the start points of neighboring scan periods of the n first scan periods is 1:3:7.

36. The method of claim 32, further comprising:

outputting a first scanning start signal and a first gate clock signal to the first gate driver by the signal controller;

outputting a second scanning start signal and a second gate clock signal to the second gate driver by the signal controller; and outputting a third scanning start signal and a third gate clock signal to the third gate driver by the signal controller.

37. The method of claim 31, wherein the data driver further applies the data voltage having two or more levels to the data line.

38. The method of claim 31, further comprising applying the gate-on voltage to the first gate line group, to the second gate line group, and to the third gate line group at the end of the first frame and applying a reset data voltage to the data line.

39. The method of claim 22, further comprising applying a data voltage having two or more levels to the data line by the data driver.

40. An electrowetting display device comprising:

a display panel comprising a plurality of pixels, each pixel comprising:

a reflecting electrode formed on a first substrate;

a first transparent electrode positioned on the reflecting electrode;

a hydrophobic insulating layer coated on the first transparent electrode;

a first fluid and a second fluid formed on the hydrophobic insulating layer, the first fluid and the second fluid being materials that are not mixed and have different electrical conductivities;

a first gate driver configured to apply gate-on voltages to gate lines of a first gate line group coupled to pixels in a first portion of the display panel in each period of n first scan periods for a first frame, n being a natural number;

a second gate driver configured to apply gate-on voltages to gate lines of a second gate line group coupled to pixels in a second portion of the display panel in each period of n second scan periods for a first frame;

a data driver configured to apply a data voltage to a plurality of data lines coupled to respective ones of the pixels; and a signal controller configured to transmit a control signal to the first gate driver, to the second gate driver and to the data driver, wherein an interval between start points of the n first scan periods is gradually decreased according to time, and an interval between start points of the n second scan periods is gradually increased according to time.

* * * * *